US009120333B2

(12) United States Patent
Tokisawa et al.

(10) Patent No.: US 9,120,333 B2
(45) Date of Patent: Sep. 1, 2015

(54) PRINTING APPARATUS AND CONTROL METHOD

(71) Applicant: CANON KABUSHIKI KAISHA, Tokyo (JP)

(72) Inventors: Toshiaki Tokisawa, Kawasaki (JP); Atsushi Miyahara, Higashikurume (JP); Kazuo Ohyama, Kawasaki (JP); Masanori Kaneko, Kawasaki (JP); Masaaki Matsuura, Kawasaki (JP); Hiroshi Nakai, Sagamihara (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/557,291

(22) Filed: Dec. 1, 2014

(65) Prior Publication Data

US 2015/0174928 A1 Jun. 25, 2015

(51) Int. Cl.
*B41J 29/38* (2006.01)
*B41J 13/00* (2006.01)

(52) U.S. Cl.
CPC ..... *B41J 13/0009* (2013.01)

(58) Field of Classification Search
CPC ..... B41J 29/38; B41J 11/0095; G03G 2215/0056
USPC ..... 347/16
See application file for complete search history.

(56) References Cited

U.S. PATENT DOCUMENTS 6,978,992 B2 12/2005 Otsuka

FOREIGN PATENT DOCUMENTS

JP 2001-39552 A 2/2011

*Primary Examiner* — Alessandro Amari
*Assistant Examiner* — Michael Konczal
(74) *Attorney, Agent, or Firm* — Fitzpatrick, Cella, Harper & Scinto

(57) ABSTRACT

A printing apparatus according to the present invention includes a feeding unit, a conveying unit, a printing unit, and a control unit. The control unit performs a successive feeding operation. An operating state of the feeding unit changes between a first operating state and a second operating state in which a feeding stop is more unstable than that in the first operating state, in a period from a start of feeding a printing medium until the printing medium reaches the conveying unit. In the successive feeding operation, a subsequent printing medium is fed without stopping until a leading end of the subsequent printing medium reaches a stoppable position. The stoppable position is arranged on an upstream side of the conveying unit. The subsequent printing medium can be stopped in the first operating state at the stoppable position.

10 Claims, 12 Drawing Sheets

PRINTING APPARATUS AND CONTROL METHOD

BACKGROUND OF THE INVENTION

1. Field of the Invention

The present invention relates to a printing apparatus and a control method.

2. Description of the Related Art

There has been proposed (in Japanese Patent Laid-Open No. 2001-039552) a printing apparatus such as an inkjet printing apparatus which adopts an operation of starting to feed a subsequent printing medium while printing on a preceding printing medium (also referred to as a successive feeding operation) in order to increase a printing speed when images are printed successively on a plurality of printing media. This successive feeding operation can increase the printing speed by reducing a gap between the preceding printing medium and the subsequent printing medium.

In the successive feeding operation of the printing media, the subsequent printing medium needs to be stopped midway along feeding and waited until image printing on the preceding printing medium has been completed. If a feeding unit stops feeding in a mechanically unstable state, the subsequent printing medium may become misaligned. This misalignment may cause problems of an overlap between the preceding printing medium and the subsequent printing medium, and a shift of the printing position of the image on the subsequent printing medium.

SUMMARY OF THE INVENTION

The present invention enables to further stabilize the stop of feeding of a printing medium.

According to an aspect of the present invention, there is provided a printing apparatus comprising: a feeding unit configured to feed a printing medium; a conveying unit configured to convey the printing medium fed from the feeding unit; a printing unit configured to print an image on the printing medium conveyed by the conveying unit; and a control unit configured to perform a successive feeding operation of controlling the feeding unit to start feeding a subsequent printing medium before the printing unit finishes a printing operation of an image on a preceding printing medium, wherein an operating state of the feeding unit changes between a first operating state and a second operating state in which a feeding stop is more unstable than that in the first operating state, in a period from a start of feeding the printing medium until the printing medium reaching the conveying unit, in the successive feeding operation, the control unit controls the feeding unit to feed the subsequent printing medium without stopping until a leading end of the subsequent printing medium reaches a stoppable position which is arranged on an upstream side of the conveying unit and at which the subsequent printing medium can be stopped in the first operating state.

Further features of the present invention will become apparent from the following description of exemplary embodiments (with reference to the attached drawings).

DESCRIPTION OF THE EMBODIMENTS

Embodiments of the present invention will be described below with reference to the drawings. Note that "printing" includes not only forming significant information such as characters and graphics but also forming images, figures, patterns, and the like on printing media in a broad sense, or processing printing media, regardless of whether the information formed is significant or insignificant or whether the information formed is visualized so that a human can visually perceive it. In addition, although in these embodiments, sheet-like paper is assumed as a "printing medium", cloth, plastic film, and the like may be used as printing media. The terms "upstream side" and "downstream side" are used with reference to the conveying direction of the printing medium, unless otherwise specified. A direction perpendicular to the conveying direction of the printing medium is indicated by an arrow X. The conveying direction (Y direction) of the printing medium is called a sub-scanning direction. A direction (X direction) perpendicular to this is sometimes called a main scanning direction.

First Embodiment

Figure 1:
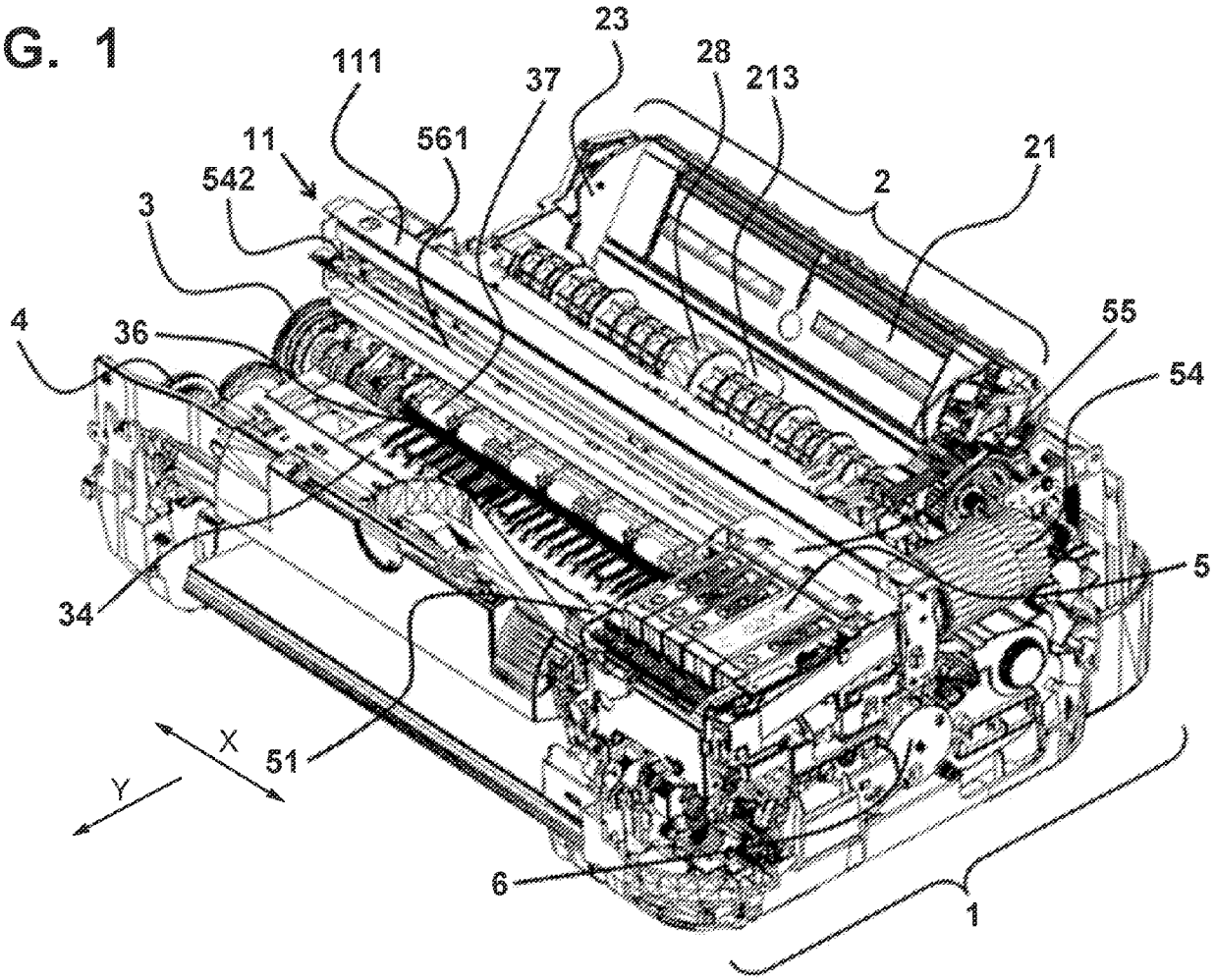
FIG. 1 a schematic view showing a printing apparatus according to an embodiment of the present invention.
Figure 2:
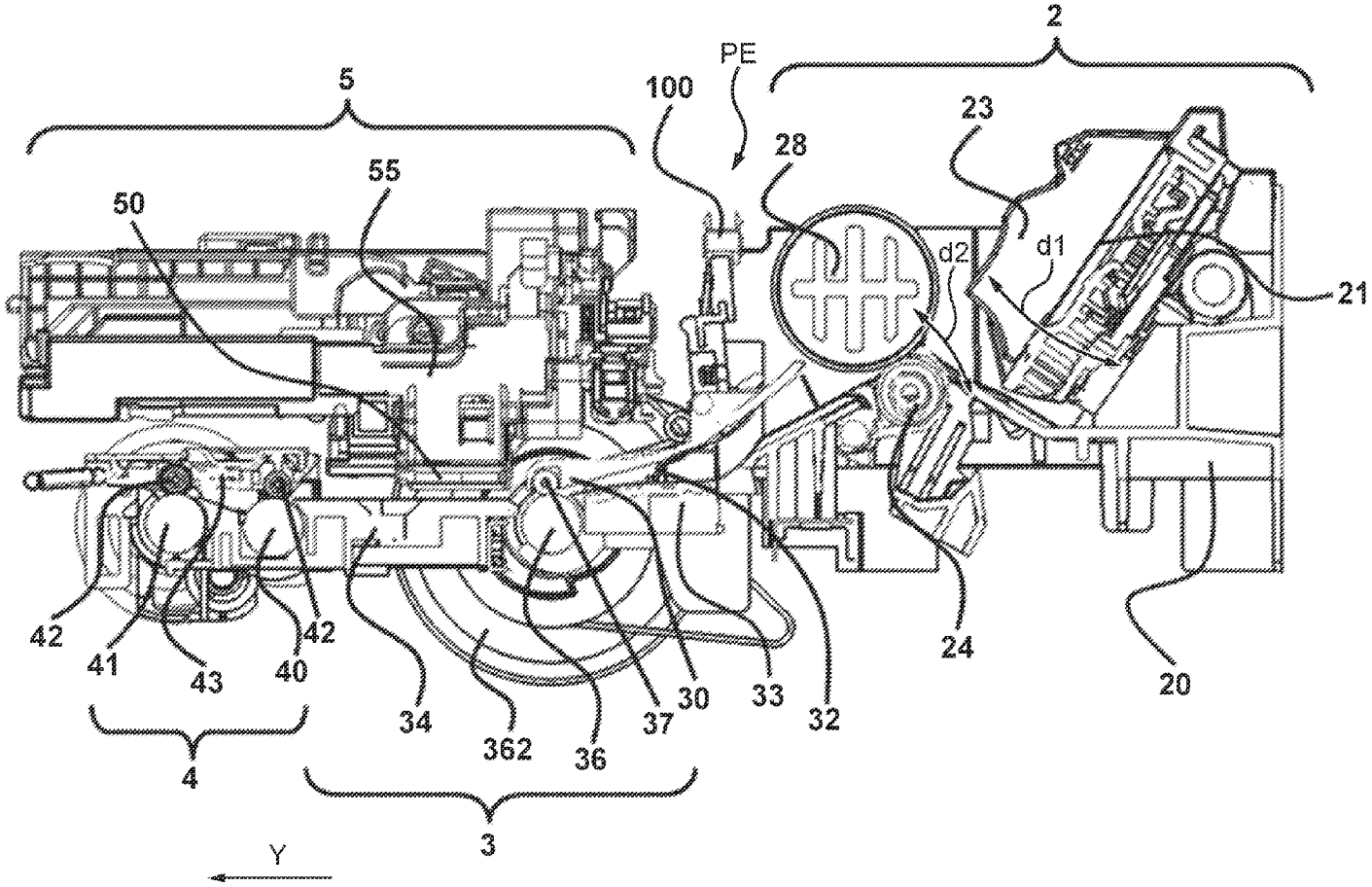
FIG. 2 is a sectional view showing a part of the printing apparatus in FIG. 1.

FIG. 1 is a schematic view of a printing apparatus 1 according to an embodiment of the present invention, and FIG. 2 is a sectional view showing a part thereof. This embodiment will exemplify a case in which the present invention is applied to a serial type inkjet printing apparatus. However, the present invention can be applied to other types of printing apparatuses. The present invention can be applied to the printing apparatus employing, for example, a laser beam printing method, a thermal transfer printing method, a thermal printing method, or a wire dot printing method. A scanning method can also employ any method such as a serial scanning method and a line scanning method. The present invention can be formed not only as a single printing apparatus such as a single printer, copying machine, or facsimile apparatus, but also as a multi-function peripheral obtained by combining these.

<Arrangement of Apparatus>

The printing apparatus 1 is configured to print an image on a printing medium by a printhead based on image information. A concrete description will be given below. The printing apparatus 1 includes a feeding unit 2, a conveying unit 3, a discharging unit 4, a printing unit 5, a recovery processing unit 6, and a sensor unit PE.

Figure 3:
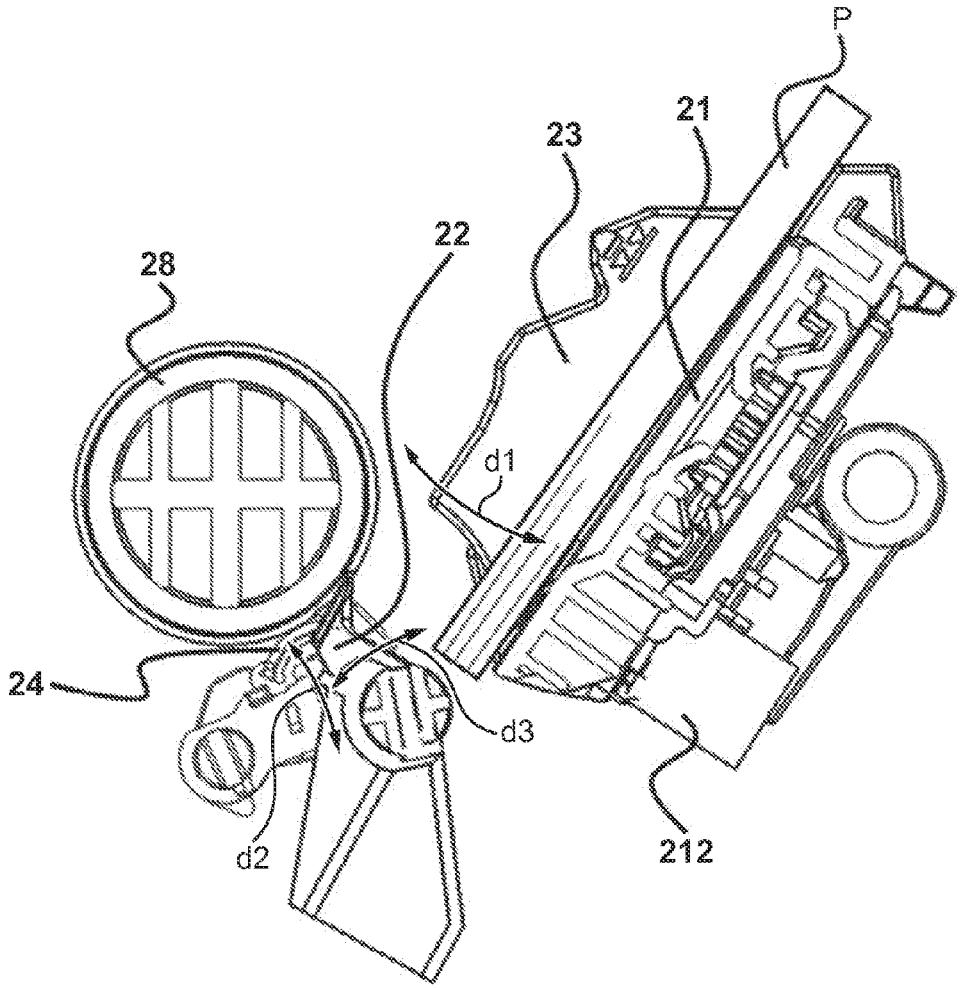
FIG. 3 is a sectional view showing a feeding unit of the printing apparatus in FIG. 1.

The feeding unit 2 will be described with reference to FIGS. 1 to 3. FIG. 3 is a sectional view showing the feeding unit 2.

The feeding unit 2 is a mechanism which feeds printing media P, and includes a pressing plate 21 on which the printing media P are stacked, a feed roller 28 which feeds the printing media, a separation roller 24 which separates the printing media, and a return lever 22 configured to return the printing media P to a stacking position. They are supported by a base 20. Note that a feed tray configured to hold the stacked printing media P can be attached to the base 20 or an exterior portion.

The feed roller 28 is one rubber roller provided in a predetermined position on a roller shaft. The roller shaft is a shaft having a cross-sectional arc shape. The feed roller 28 rotates along with the rotation of the roller shaft, thereby feeding the uppermost printing medium P on the pressing plate 21. The feeding unit 2 includes a feed motor serving as the driving source of the feed roller 28. The feed motor is also used as the driving source of the recovery processing unit 6. The recovery processing unit 6 carries out, for example, the maintenance of the printhead.

The pressing plate 21 is a movable portion which can change its position. In this embodiment, the pressing plate 21 can move by pivoting in the direction of an arrow d1 between a working position which comes close to the feed roller 28 and a retreat position which is spaced apart from the feed roller 28. The pressing plate 21 moves to the working position, bringing the uppermost printing medium P stacked on the pressing plate 21 into contact with the feed roller 28. The pressing plate 21 is always biased on a working position side by a pressing plate spring 212.

A movable side guide 23 configured to control the stacking position of the printing media P and be able to move is attached to the pressing plate 21. A portion of the pressing plate 21 facing the feed roller 28 is provided with a separation portion 213 having a large coefficient of friction. This prevents erroneous conveyance of multiple printing media P when the number of remaining stacked printing media P on the pressing plate 21 becomes a few.

The separation roller 24 is a movable portion which can change its position. In this embodiment, the separation roller 24 can move by pivoting in the direction of an arrow d2 between a retreat position which is spaced apart from the feed roller 28 and a working position which is pressed with pressure against the feed roller 28 to prevent the erroneous conveyance of multiple printing media P.

The separation roller 24 is pivotally supported by the base 20 via a holder (not shown), and always biased on the working position side by the spring or the like. A clutch spring serving as a torque limiter is attached to the separation roller 24. The separation roller 24 rotates when a predetermined load torque or more acts on it. Therefore, the separation roller 24 rotates together with the feed roller 28 in a state in which no printing medium intervenes in a nip portion between the feed roller 28 and the separation roller 24, and in a state in which one printing medium intervenes in the nip portion. The separation roller 24 stop moving in a state in which two or more printing media intervene in the nip portion. Therefore, in the state in which the plurality of printing media intervene in the nip portion, only the printing medium contacting the feed roller 28 is fed. By doing so, the erroneous conveyance of multiple printing media is prevented.

The return lever 22 is a movable portion which can change its position. In this embodiment, the return lever 22 is pivotally supported by the base 20, and can move in the direction of an arrow d3 so as to return the printing medium P which has reached the nip portion to a pressing plate side. The return lever 22 is always biased, by the spring or the like, in a release direction opposite to the pressing plate 21. A position on the side of the pressing plate 21 is called the working position, and a position in the release direction side is called the retreat position.

As described above, this embodiment includes the plurality of movable portions. Each of the pressing plate 21, the separation roller 24, and the return lever 22 is assigned a control cam (not shown), and moved to the working position by operating the controller cam. Each position of the pressing plate 21, the return lever 22, and the separation roller 24 is detected by an ASF sensor (not shown), and each operation thereof is controlled by the control cam.

The conveying unit 3, the discharging unit 4, and the printing unit 5 will be described with reference to FIGS. 1 and 2.

The conveying unit 3 is a mechanism which conveys the printing media P fed by the feeding unit 2 to pass through the printing unit 5, and supported by a chassis 11. The conveying unit 3 includes a conveying roller 36 serving as a driving roller and a plurality of pinch rollers 37 each serving as a driven roller. Each pinch roller 37 is held in a pinch roller holder 30 and pressed with pressure against the conveying roller 36 by a pinch roller spring (not shown). The pinch roller holder 30 includes a rotating shaft supported by the bearings of the chassis 11, and can rotate about the rotating shaft.

A guide flapper 33 configured to guide the printing media P is arranged near the inlet of the conveying unit 3 to which the printing media P are fed. A platen 34 is arranged on the downstream side of the conveying roller 36. The platen 34 is positioned by and attached to the chassis 11. The guide flapper 33 is rotatably supported by the shaft portion of the conveying roller 36, and typically held in a position contacting the chassis 11. The printing media which have been fed to the conveying unit 3 are guided by the pinch roller holder 30 and the guide flapper 33, and reach a nip portion between the conveying roller 36 and the pinch rollers 37.

The printing media P are conveyed on the platen 34 by rotationally driving the conveying roller 36. A rib serving as a conveyance reference surface (conveyance supporting surface) is formed on the platen 34. This rib controls a space between the printing media P and a printhead 50 included in the printing unit 5, and cooperates with a discharge roller 40 to be described later to suppress the undulation of the printing media P.

The driving mechanism of the conveying roller 36 includes a conveyance motor serving as a driving source and a transmission mechanism which transmits the driving force of the conveyance motor to the conveying roller 36. The transmission mechanism is, for example, a belt transmission mechanism and transmits the rotating force of the conveyance motor such as a DC motor to a pulley (not shown) provided on the roller shaft of the conveying roller 36 by a timing belt or the like. A code wheel 362 is provided on the roller shaft of the conveying roller 36. A conveyance amount by the conveying roller 36 can be detected by reading the code wheel 362 using an encoder sensor (not shown) attached to the chassis 11.

The sensor unit PE detects the positions of the leading end and trailing end of each printing medium P. In this embodiment, the detection position is set on the upstream side of the conveying roller 36 and the downstream side of the separation roller 24, and the passage of the leading end and trailing end of each printing medium P is detected. In this embodiment, the sensor unit PE includes a sensor 100 and a sensor lever 32. The sensor 100 is, for example, an optical sensor. The sensor lever 32 is rotationally supported by the pinch roller holder 30, and pivots upon the arrival and the passage of the printing media P. The sensor 100 detects the movement of the sensor lever 32, thereby detecting the positions of the leading end and the trailing end of each printing medium P.

The printing unit 5 includes a carriage 55 which reciprocally moves in the X direction and the printhead 50 mounted on the carriage 55. The printhead 50 is positioned on the downstream side of the conveying roller 36. The printhead 50 prints an image on the printing medium while moving the carriage 55 in the X direction with respect to the printing media P conveyed on the platen 34.

The carriage 55 is guided and supported to be reciprocally movable in the X direction by a guide rail 111. The carriage 55 is driven via a timing belt (not shown) by a carriage motor 54. The timing belt is wound around a driving pulley attached to the carriage motor 54 and an idle pulley 542. The timing belt is coupled to the carriage 55 via a damper made of rubber or the like. This damps the vibration of the carriage motor 54 or the like, thereby reducing, for example, image nonuniformity.

A code strip 561 is provided in parallel to the timing belt. The position of the carriage 55 is detected by reading the marking of the code strip 561 using the encoder sensor mounted on an electric board on the carriage 55. A contact for electrically connecting to the printhead 50 is also provided on this electric board. A flexible board 57 connects the electric board on the carriage 55 and an electric board on an apparatus main body side.

The printhead 50 is positioned and fixed detachably from the carriage by a head set lever 51 rotatably attached to the carriage 55.

When printing an image on the printing medium P, the printing medium P is conveyed to a row position (a printing position in the Y direction) where the image is formed by driving the conveying roller 36. Next, the carriage motor 54 moves the carriage 55 to a printing start position in the X direction. Then, the printhead 50 prints an image based on an image signal from the aforementioned electric board. After that, this operation is repeated, thereby printing images. That is, when the images are printed on the printing media P, the conveying unit 3 intermittently conveys the printing media P, and the printing unit 5 prints the images while the conveying unit 3 stops conveying the printing media P.

In this embodiment, the printhead 50 is an inkjet printhead which discharges ink from an orifice based on image information. The printhead 50 prints the images on the printing media P by discharging ink from the orifice in synchronism with the movement of the carriage 55 in the X direction. Ink tanks of respective color inks are exchangeably attached to the printhead 50. Note that the printhead 50 is configured to apply heat to ink within the orifice by a heater or the like, cause film boiling of ink by this heat, and discharge ink from the orifice upon pressure change generated by the growth or the shrinkage of a bubble caused by this film boiling.

The discharging unit 4 includes two discharge rollers 40 and 41, and spurs 42 which are pressed with pressure against these discharge rollers to follow/rotate. The discharge rollers 40 and 41 are driven in synchronism with the conveying roller 36. The respective discharge rollers 40 and 41 are attached on the downstream side of the platen 34 arranged facing the printhead 50. Out of two discharge rollers 40 and 41, the discharge roller 40 on the upstream side has a structure in which a plurality of roller rubber portions are provided on a metal shaft, and is driven by a rotating force transmitted from the conveying roller 36 via an idler gear. On the other hand, the discharge roller 41 on the downstream side has a structure in which a plurality of elastomeric elastic bodies are attached onto a resin shaft, and is driven by a rotating force transmitted from the discharge roller 40 via the idler gear.

Each spur 42 is attached to a spur holder 43 by a spur spring (not shown) formed from a rod-like coil spring, and pressed against the discharge rollers 40 and 41 by the biasing force of the spur spring. The spurs 42 are classified into two types; one which is arranged in position corresponding to the rubber portion (elastic body portion) of each of the discharge rollers 40 and 41 and mainly generates the conveyance force of the printing medium, and the other which is arranged in a position between them where no rubber portion (elastic body portion) exists and mainly suppresses the floating of the printing medium when printing.

By the above-described arrangement, each printing medium P on which the image has been printed by the printing unit 5 is finally discharged onto a discharge tray (not shown) outside an apparatus main body while being sandwiched by a nip portion between the discharge roller 41 and the spurs 42, and conveyed.

Figure 4:
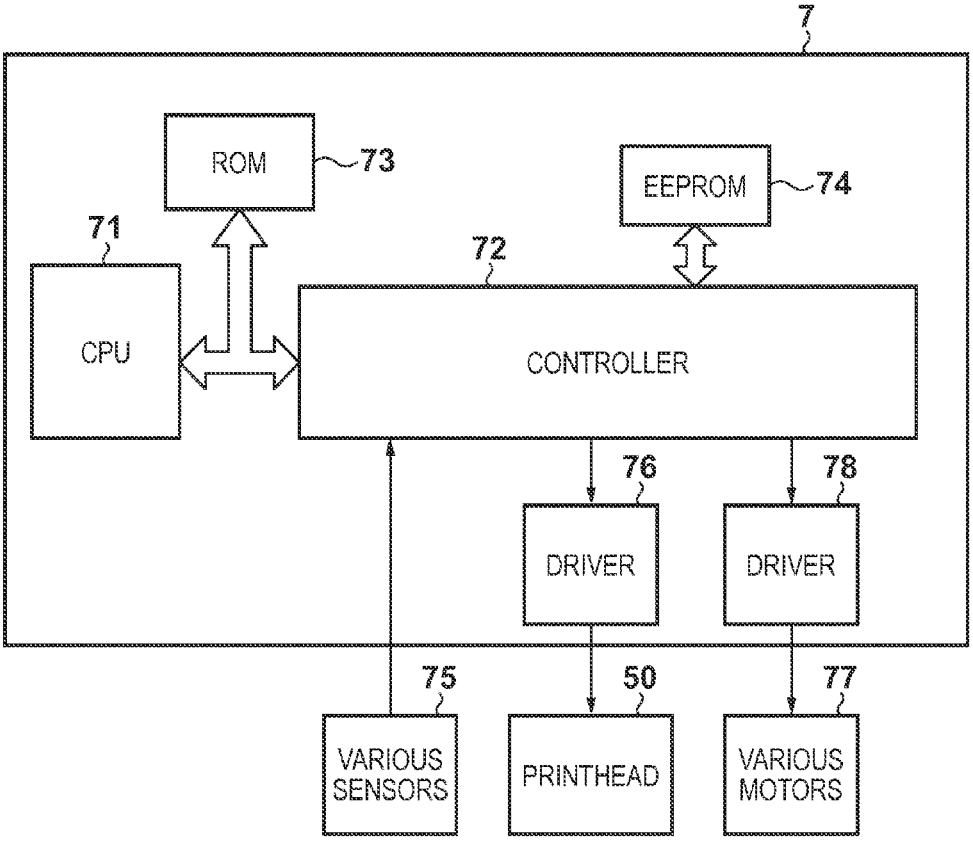
FIG. 4 is a block diagram showing a control unit.

The arrangement of the control system of the printing apparatus 1 will be described with reference to FIG. 4. FIG. 4 is a block diagram showing a control unit 7 which controls the printing apparatus 1. A control unit 7 controls the operation of each mechanism unit of the printing apparatus 1. Only parts associated with the explanation of this embodiment will be described here. A CPU 71 controls the entire printing apparatus 1. A controller 72 assists the CPU 71 and controls the driving of various motors 77 and the printhead 50 in accordance with detection results from various sensors 75.

A ROM 73 stores various data, the control programs of the CPU 71, and the like. An EEPROM 74 stores, for example, the various data. Note that other storage devices may be employed in place of the ROM 73 and the EEPROM 74.

A driver 78 drives the various motors 77. The various motors 77 include the above-described feed motor, conveying motor, and carriage motor. A motor which drives the pressing plate 21, the separation roller 24, and the return lever 22 is also used as the feed motor. However, another motor may be provided. A driver 76 drives the printhead 50. The various sensors 75 include the sensor 100, an AFS sensor, and the encoder sensor.

<Operating State of Feeding Unit>

The operating state of the feeding unit 2 according to this embodiment changes, form its mechanism point of view, in a period from the start of feeding the printing media P until the reaching of the printing media P to the conveying unit 3.

In a standby state before feeding, the pressing plate 21 is positioned in the retreat position. The separation roller 24 is positioned in the working position. The return lever 22 is positioned in the working position and blocks a stacking port at the bottom of the pressing plate 21.

The feed roller 28 starts rotating along with the start of a feeding operation. Then, the return lever 22 is moved to the retreat position, and the pressing plate 21 is moved to the working position and contacts the feed roller 28. This starts the feeding of the printing media P on the pressing plate 21. The printing media P sent to a nip portion between the feed roller 28 and the separation roller 24 are separated in the nip portion, and only one uppermost printing medium is fed.

After that, while the pressing plate 21 starts moving to the retreat position, the return lever 22 starts moving to the working position. The separation roller 24 temporarily moves to the retreat position to avoid interference between the return lever 22 and the separation roller 24. Once the return lever 22 completes moving to the working position, the second and subsequent printing media P that have reached the nip portion between the feed roller 28 and the separation roller 24 are returned to the stacking position on the pressing plate 21.

Figure 5A:
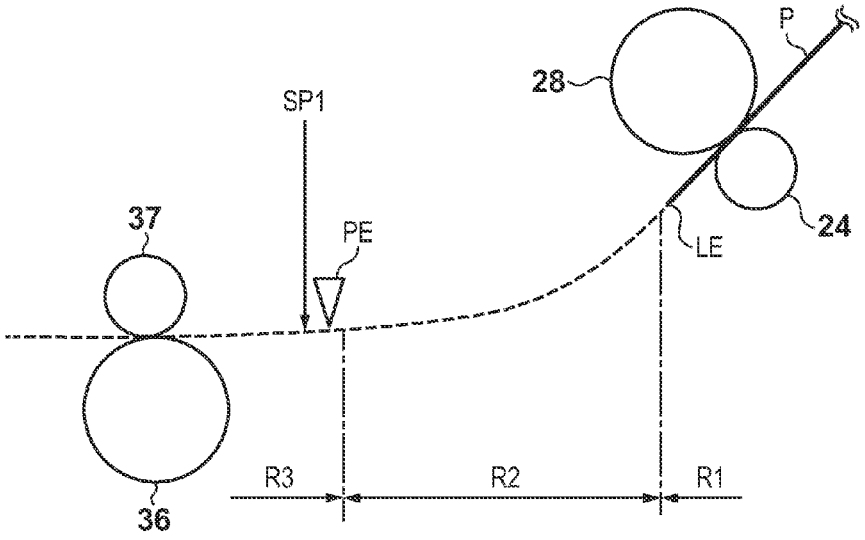
FIGS. 5A and 5B are views for explaining the operating state of the feeding unit.
Figure 5B:
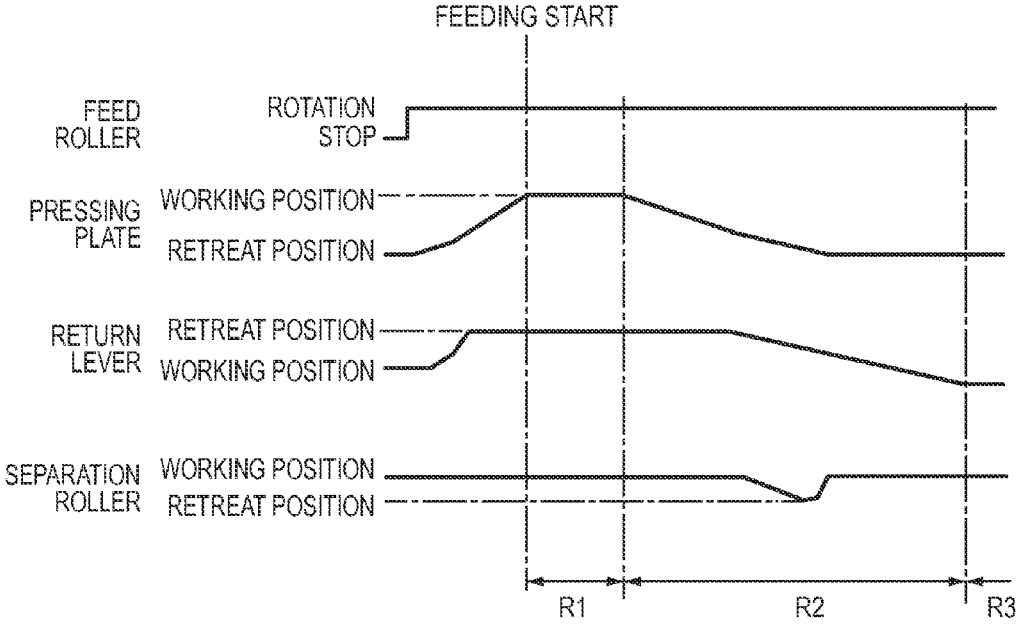

FIG. 5A is a view for explaining the feeding position of the printing medium P and the operating state of the feeding unit 2. FIG. 5B is a timing chart showing the operation of each arrangement of the feeding unit 2. FIG. 5B shows the rotation and stop states of the feed roller 28. FIG. 5B also shows changes in the rotation positions of the respective control cams of the pressing plate 21, the return lever 22, and the separation roller 24. The respective control cams operate the pressing plate 21, the return lever 22, and the separation roller 24. Accordingly, FIG. 5B substantially shows the positions of the pressing plate 21, the return lever 22, and the separation roller 24.

Referring to FIG. 5B, in a section R1 in a predetermined range from the start of feeding the printing medium P, no positional changes of the pressing plate 21, the return lever 22, and the separation roller 24 are observed. On the other hand, in a subsequent section R2, at least one of the positions of the pressing plate 21, the return lever 22, and the separation roller 24 is changed. In a section R3 subsequent to the section R2, again, no positional changes of the pressing plate 21, the return lever 22, and the separation roller 24 are observed. Therefore, a feeding stop becomes more unstable in the operating state in the section R2 than in those in the sections R1 and R3.

For example, in an operation where the pressing plate 21 is made to contact and then separate from the feed roller 28, the feed roller 28 is driven while receiving the reaction force of the pressing plate spring 212. In case of stopping driving the feed roller 28 midway along feeding, the feed roller 28 may not be able to stop at a target stop position with stability owing to the reaction force of the pressing plate spring 212. Furthermore, at a timing when the separation roller 24 is temporarily separated from the feed roller 28, the printing medium P is not nipped between these rollers. Therefore, in this case as well, the printing medium P may not be able to stop at the target position. The stop of the printing medium P may also become unstable while operating the return lever 22.

FIG. 5A shows a relationship, with reference to a leading end LE of the printing medium P, between the position of the printing medium P and the sections R1 to R3 at that time. An example of FIG. 5A illustrates positions from the position of the leading end LE to the position of the printing medium P in the section R1. After that, as the printing medium P is fed from the section R2 to the section R3, the leading end LE reaches a position beyond the detection position by the sensor unit RE.

In this embodiment, the feeding of the printing medium P stops when the leading end LE of the printing medium P reaches a stoppable position SP1. The feeding may only stop in a successive feeding operation to be described later. In this embodiment, however, the feeding stops in any cases. When the leading end LE of the printing medium P reaches the stoppable position SP1, the operating state of the feeding unit 2 corresponds to that in the section R3. That is, the feeding of the printing medium P can further be stabilized than in the section R2.

In this embodiment, the stoppable position SP1 is set to avoid the entire section R2. Instead, the stoppable position SP1 may be set to avoid a part of the section R2. In a case, for example, where the feeding stop becomes most unstable while moving the pressing plate 21 but does not become worse so much while moving another moving portion, the stoppable position SP1 can be set to only avoid a section where the pressing plate 21 moves.

<Example of Control>

Figure 6:
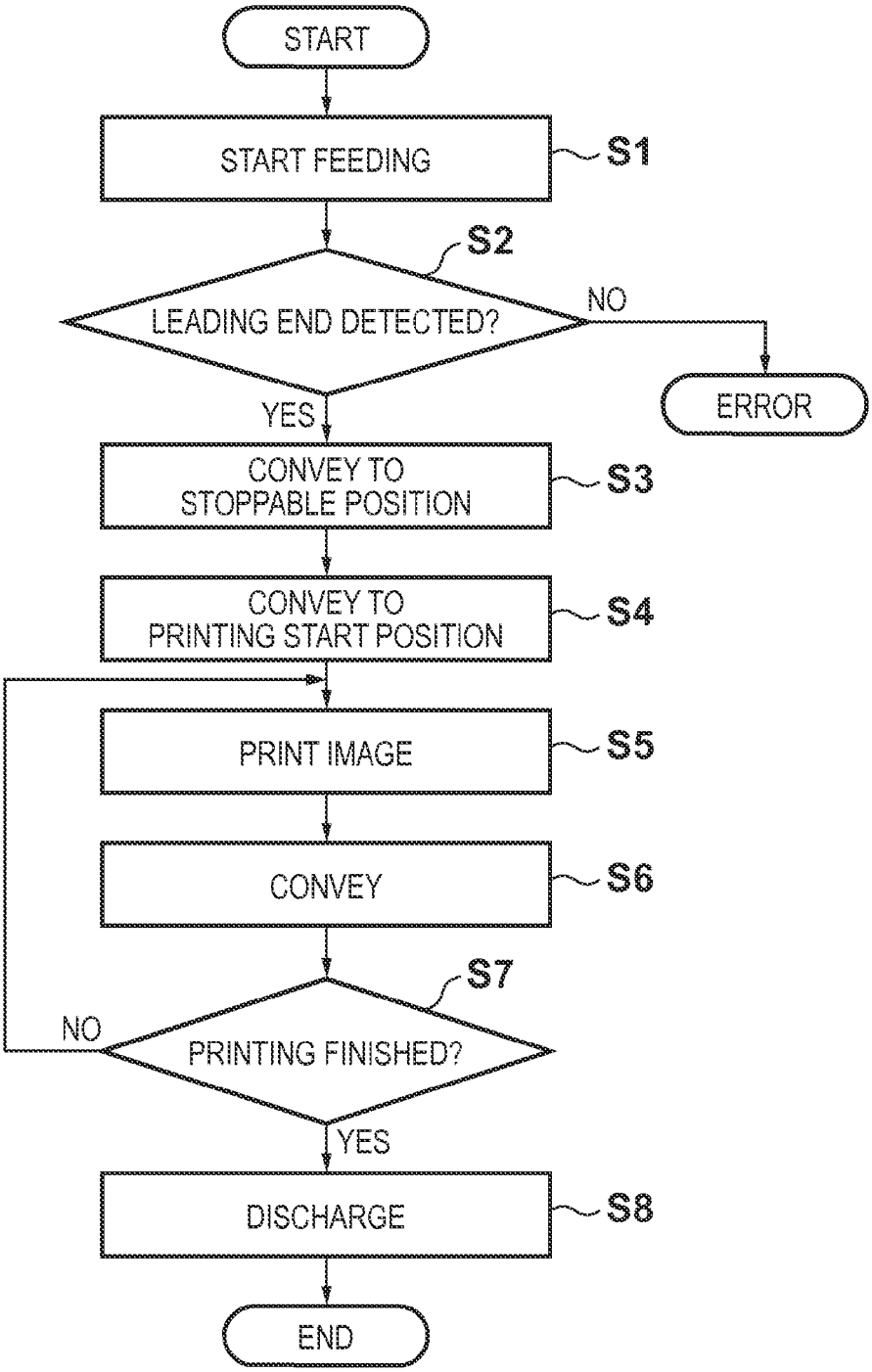
FIG. 6 is a flowchart showing an example of the processing executed by the control unit.
Figure 7A:
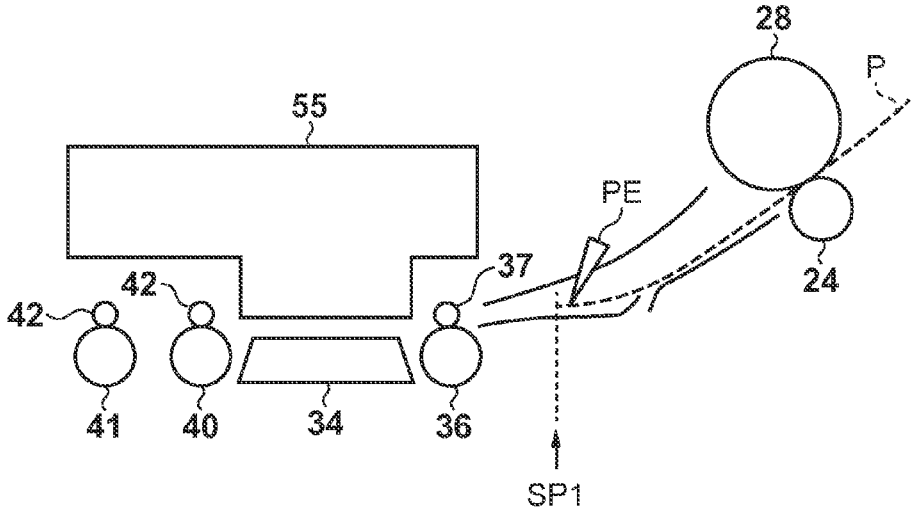
FIGS. 7A and 7B are views for explaining an example of feeding of the printing medium.
Figure 7B:
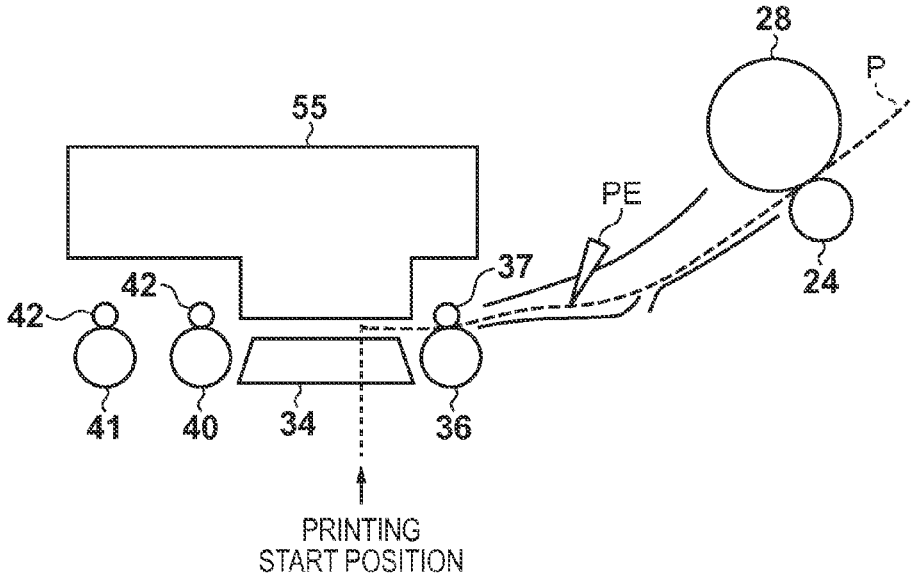

A series of operations of printing an image on one printing medium P will now be described with reference to FIG. 6, and FIGS. 7A and 7B. FIG. 6 shows an example of the processing executed by the CPU 71 of the control unit 7. FIGS. 7A and 7B are schematic views showing the operation of the printing apparatus 1.

One or the plurality of printing media P are stacked on the pressing plate 21. A feeding operation starts upon receipt of a printing instruction from a host computer or the like (step S1). The feed roller 28 feeds the first printing medium. It is determined whether the sensor unit PE detects the leading end LE of the printing medium P (step S2). If the detection is not made within a predetermined time, error processing is performed.

If the leading end LE of the printing medium P is detected, the process advances to step S3. The printing medium P stops at the position (stoppable position SP1) where the printing medium is conveyed by a predetermined amount after the sensor unit PE detects the leading end thereof. FIG. 7A shows a state in which the feeding of the printing medium P stops at the stoppable position SP1. As described above, the stoppable position SP1 is set to be able to stop feeding in the section R3. It is therefore possible to increase the stop position accuracy of the printing medium P. Also in this embodiment, the stoppable position SP1 is positioned on the downstream side of the detection position by the sensor unit PE. The printing medium P can be stopped using the detection result from the sensor unit PE. This makes it possible to further increase the stop position accuracy of the printing medium P.

Next, the process advances to a printing operation. In the printing operation, first, the printing medium P whose leading end stops at the stoppable position SP1 is conveyed to a printing start position by the printhead 50 (step S4). The feed roller 28 and the conveying roller 36 start rotating at the same time, thereby conveying the printing medium P to the printing start position at a predetermined distance away from the nip portion between the conveying roller 36 and the pinch rollers 37. FIG. 7B shows a state in which the leading end LE of the printing medium P reaches the printing start position.

The driving of the feed roller 28 stops in a state in which the leading end of the printing medium P is nipped between the conveying roller 36 and the pinch rollers 37, and then the separation roller 24 is separated from the feed roller 28 after the feed roller 28 is driven by a predetermined amount. Note that the printing start position is not always fixed to a set position because it changes depending on, for example, a margin amount on the leading end side of the printing medium P. After the printing medium P is conveyed to the printing start position, the carriage 55 starts driving, and the printhead 50 discharges ink onto the printing medium P, thereby printing an image (step S5). Then, the conveying roller 36 is driven again to convey the printing medium P by a predetermined amount (step S6). In step S7, it is determined whether the entire image has been printed on the printing medium P. If YES, the process advances to step S8; if NO, returns to step S5.

When the printing ends, the conveying roller 36 and the discharge roller 41 are driven at the same time to perform a discharging operation, thereby discharging the printing medium P onto the discharge tray. That is the procedure of the series of operations when printing on one printing medium P.

Figure 8:
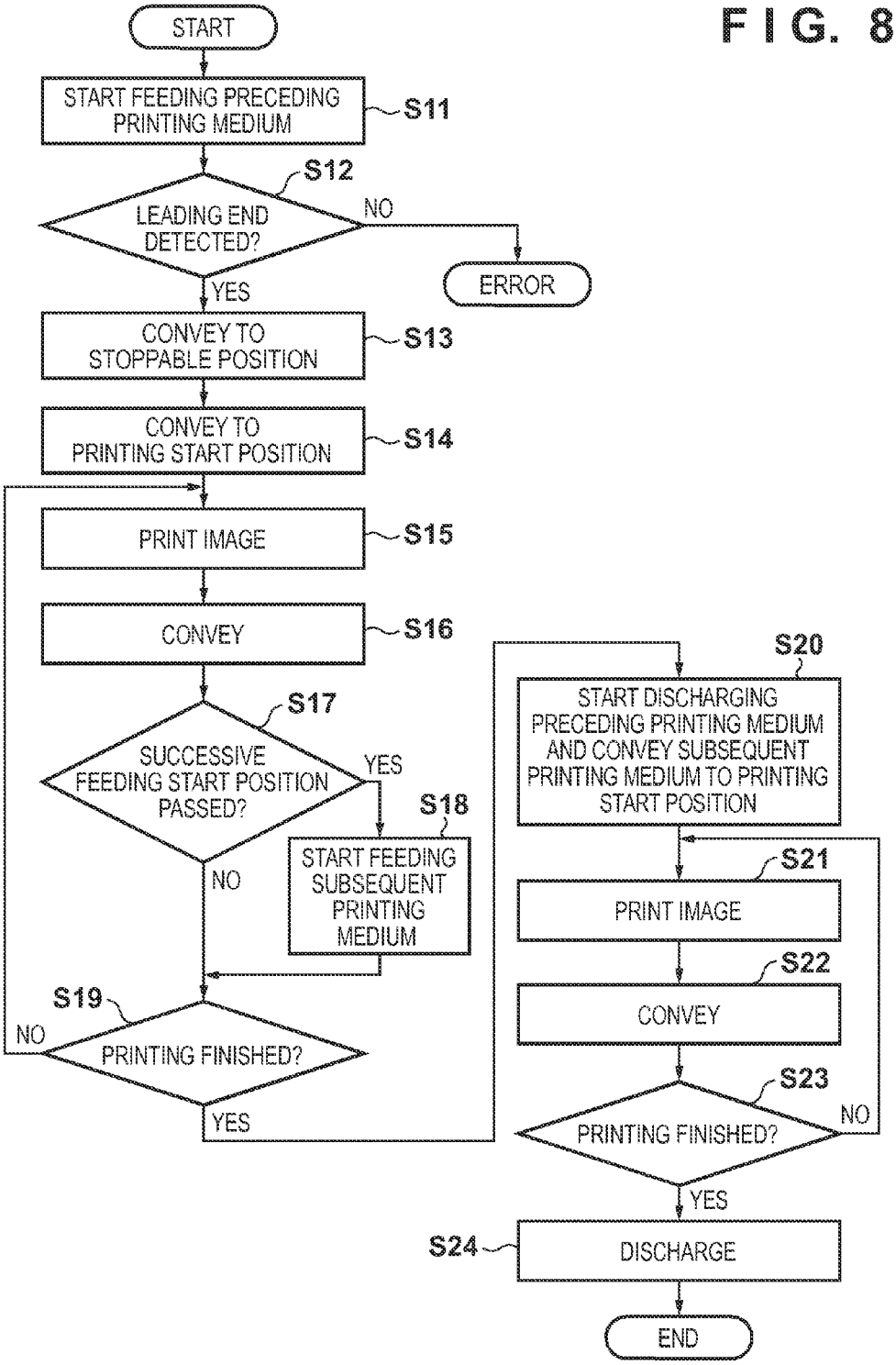
FIG. 8 is a flowchart showing an example of the processing executed by the control unit.
Figure 9A:
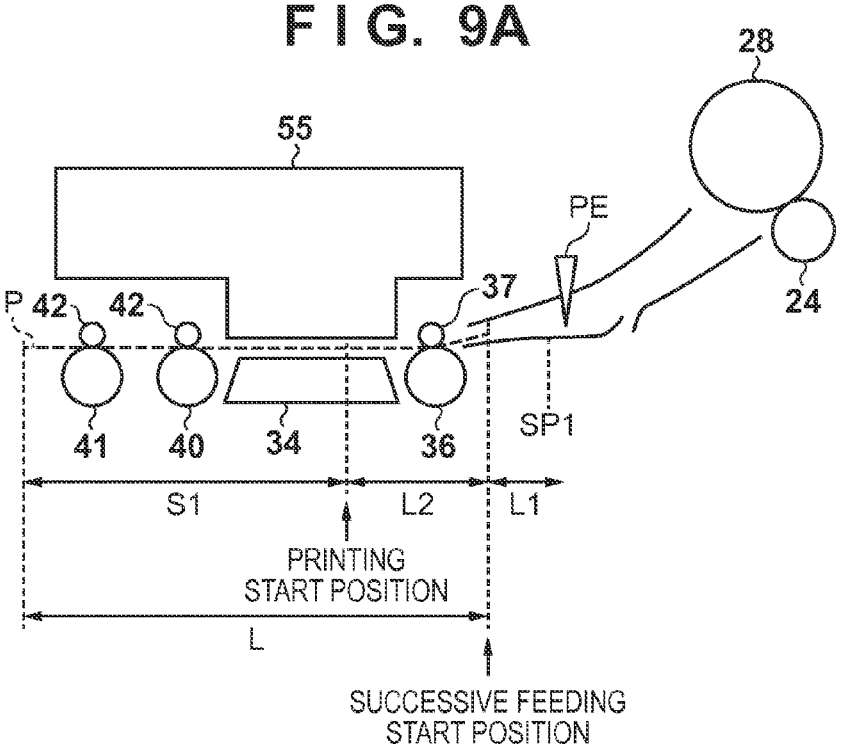
FIGS. 9A and 9B are views for explaining an example of feeding of printing media.
Figure 9B:
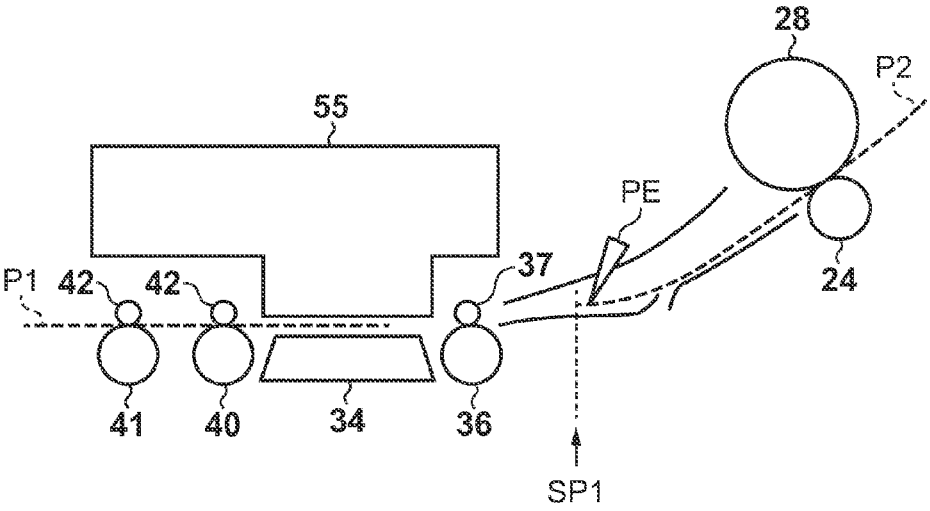

An example of printing images successively on the plurality of printing media P will now be described with reference to FIG. 8, and FIGS. 9A and 9B. FIG. 8 shows an example of the processing executed by the CPU 71 of the control unit 7. FIGS. 9A and 9B are schematic views showing the operation of the printing apparatus 1. When the images are printed successively on the plurality of printing media P, the successive feeding operation of the printing media P can be performed. In the successive feeding operation, after the start and before the end of the printing operation of the images by the printing unit 5 on the preceding printing medium P, the feeding unit 2 starts feeding the subsequent printing medium P. A case in which the images are printed successively on two printing media P will be described below. However, the same also applies to a case for three or more printing media P.

First, as in the above-described case of printing on one printing medium, the first printing medium P (to be referred to as a preceding printing medium P1 hereinafter) is fed by the feed roller 28 and stops at a position where the leading end thereof reaches the stoppable position SP1. More specifically, the feeding operation starts upon receipt of the printing instruction from the host computer or the like (step S11). The feed roller 28 feeds the preceding printing medium P1. It is determined whether the sensor unit PE detects the leading end LE of the preceding printing medium P1 (step S12). If the detection is not made within a predetermined time, error processing is performed.

If the leading end LE of the preceding printing medium P1 is detected, the process advances to step S13. The preceding printing medium P1 stops at the position (stoppable position SP1) where the preceding printing medium is conveyed by a predetermined amount after the sensor unit PE detects the leading end thereof.

Next, the process advances to a printing operation. In the printing operation, first, the preceding printing medium P1 whose leading end stops at the stoppable position SP1 is conveyed to a printing start position by the printhead 50 (step S14). The feed roller 28 and the conveying roller 36 start rotating at the same time, thereby conveying the preceding printing medium P1 to the printing start position at a predetermined distance away from the nip portion between the conveying roller 36 and the pinch rollers 37.

After the preceding printing medium P1 is conveyed to the printing start position, the carriage 55 starts driving, and the printhead 50 discharges ink onto the preceding printing medium P1, thereby printing an image (step S15). Then, the conveying roller 36 is driven again to convey the printing medium P by a predetermined amount (step S16).

In step S17, it is determined whether the trailing end of the preceding printing medium P1 has passed a successive feeding start position. If YES, the process advances to step S18; if NO, returns to step S19. In this embodiment, the successive feeding start position is set on the upstream side of the conveying roller 36 and the downstream side of the stoppable position SP1, as shown in FIG. 9A. Whether the trailing end of the preceding printing medium P1 has passed the successive feeding start position is determined based on the driving amount of the conveying roller 36 since the sensor unit PE detected the trailing end of the preceding printing medium P1. As shown in FIG. 9A, the driving amount corresponds to a distance L1.

In step S18, feeding of the second printing medium P (to be referred to as a subsequent printing medium P2 hereinafter) starts. As shown in FIG. 9B, the subsequent printing medium P2 is fed to a position where the leading end thereof reaches the stoppable position SP1.

In step S19, it is determined whether the entire image has been printed on the preceding printing medium P1. If YES, the process advances to step S20; if NO, returns to step S15.

In step S20, operations of starting the discharge of the preceding printing medium P1 and conveying the subsequent printing medium P2 to the printing start position are performed. When the subsequent printing medium P2 is fed again to the printing start position, the discharge roller 41 conveys the preceding printing medium P1 by the same distance as the subsequent printing medium P2 has been conveyed. This is because the driving of the conveying roller 36 and the driving of the discharge roller 41 are linked to each other. Hence, as the printing on the subsequent printing medium P2 proceeds, the preceding printing medium P1 is discharged onto the discharge tray.

After the subsequent printing medium P2 is conveyed to the printing start position, the carriage 55 starts driving, and the printhead 50 discharges ink onto the subsequent printing medium P2, thereby printing an image (step S21). Then, the conveying roller 36 is driven again to convey the subsequent printing medium P2 by a predetermined amount (step S22). In step S23, it is determined whether the entire image has been printed on the subsequent printing medium P2. If YES, the process advances to step S24; if NO, returns to step S21.

When the printing ends, the conveying roller 36 and the discharge roller 41 are driven at the same time to perform a discharging operation, thereby discharging the subsequent printing medium P2 onto the discharge tray. That is the procedure of the series of operations when printing on two printing media P.

As described above, by feeding the subsequent printing medium P2 while printing on the preceding printing medium P1, the printing operation on the subsequent printing medium P2 can be performed immediately after finishing printing on the preceding printing medium P1. This makes it possible to shorten a total printing time. The subsequent printing medium P2 is conveyed without stopping feeding midway along feeding from its feeding start to the stoppable position SP1. This makes it possible to avoid a feeding stop in the section R2 where the feeding stop is unstable. By setting the stoppable position SP1 in a position on the upstream side of the conveying roller 36 and closer to the printing start position, it is possible to further shorten a subsequent conveyance time.

Second Embodiment

Depending on the size of the printing area of an image on a printing medium P, image printing may end before the trailing end of the printing medium P passes a successive feeding start position. In an example of the successive feeding start position shown in FIG. 9A, when a length S1 of a printing area on the preceding printing medium P1 satisfies a relationship "$S1 \geq L-L2$" relative to a length L of the printing medium P (to be referred to as "when the printing area S1 is long" hereinafter), the image printing has not ended yet when the trailing end of the printing medium P passes the successive feeding start position.

On the other hand, when the length S1 of the printing area satisfies a relationship "$S1 < L-L2$" (to be referred to as "when the printing area S1 is short" hereinafter), the trailing end of the preceding printing medium P1 never passes the successive feeding start position during printing. That is, the trailing end of the preceding printing medium P1 passes the successive feeding start position after a printing operation on the preceding printing medium P1 is complete. As a result, the feeding of a subsequent printing medium P2 is not started at an early stage.

In this embodiment, a stoppable position is set in accordance with the length of the printing area of the image on the preceding printing medium P. A second stoppable position SP2 is also set here in addition to a stoppable position SP1. The second stoppable position SP2 is also set to avoid a section R2 where a feeding stop becomes unstable. By preparing a plurality of candidate positions which can be set as the stoppable positions in this way, it is possible to perform a successive feeding operation in correspondence with the printing area of the image on the preceding printing medium P.

Figure 10:
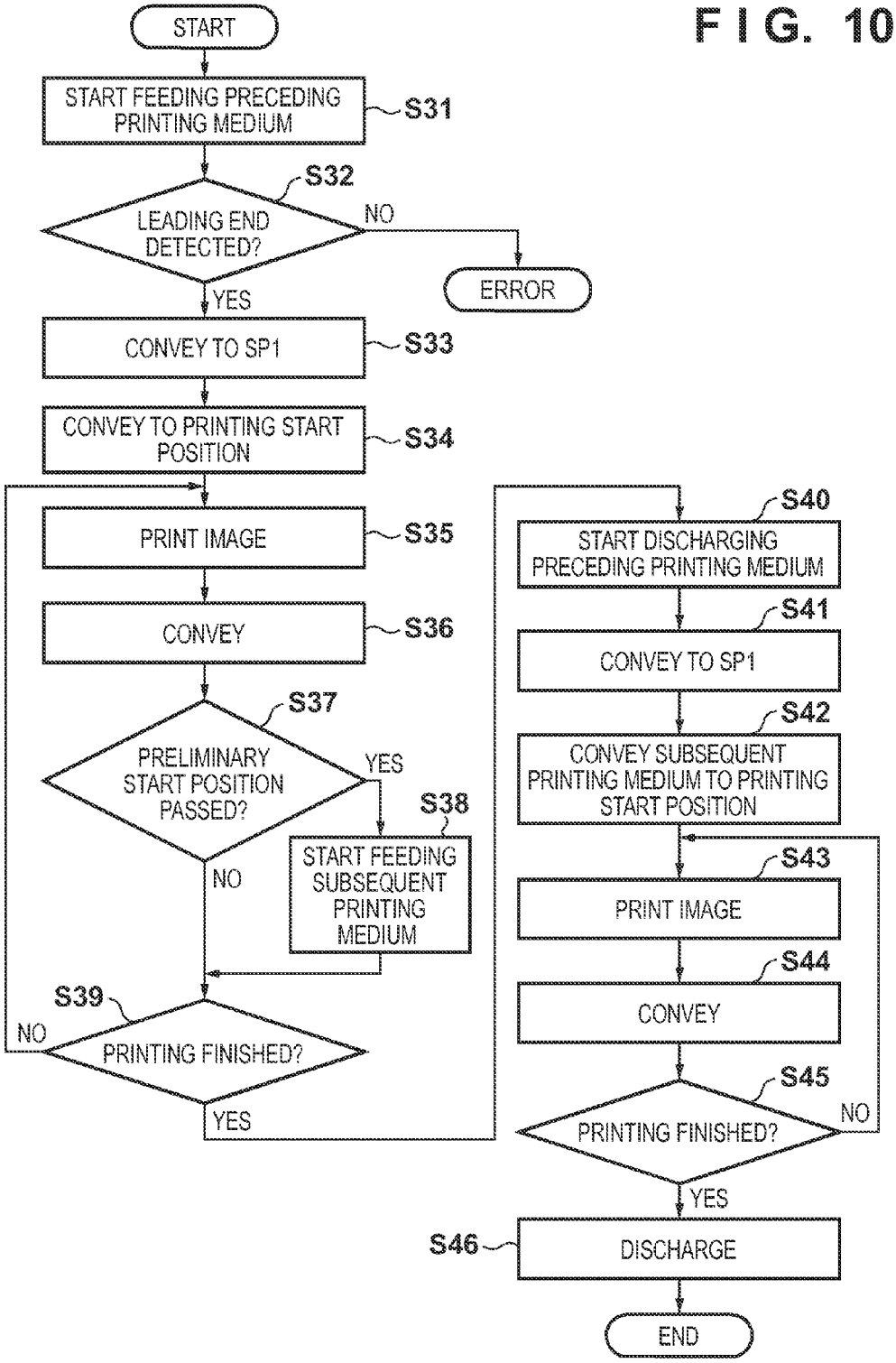
FIG. 10 is a flowchart showing an example of the processing executed by a control unit.
Figure 11A:
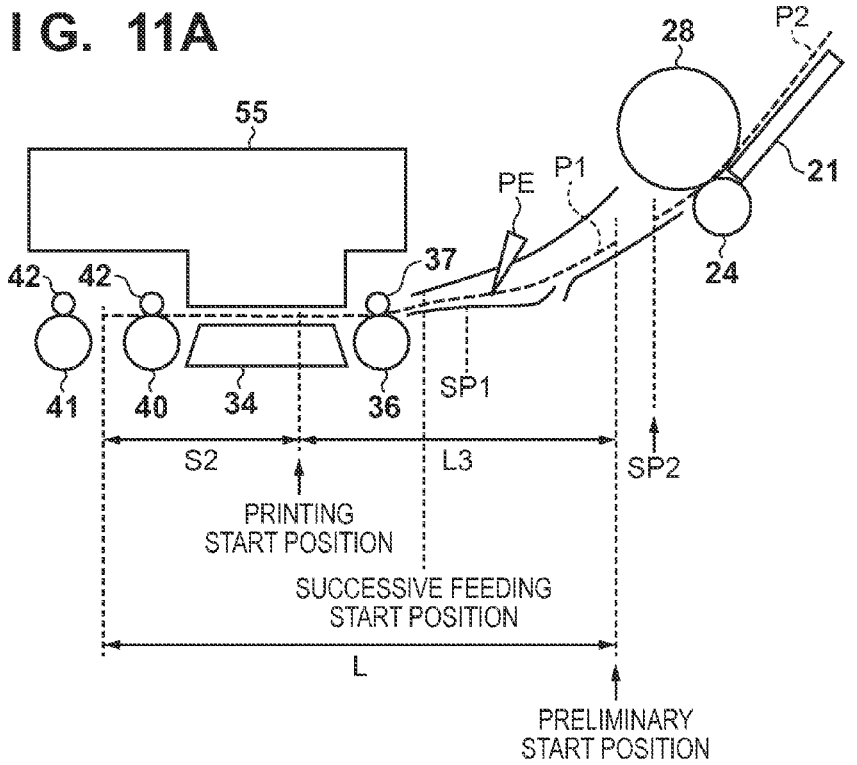
FIGS. 11A and 11B are views for explaining an example of feeding of the printing media.
Figure 11B:
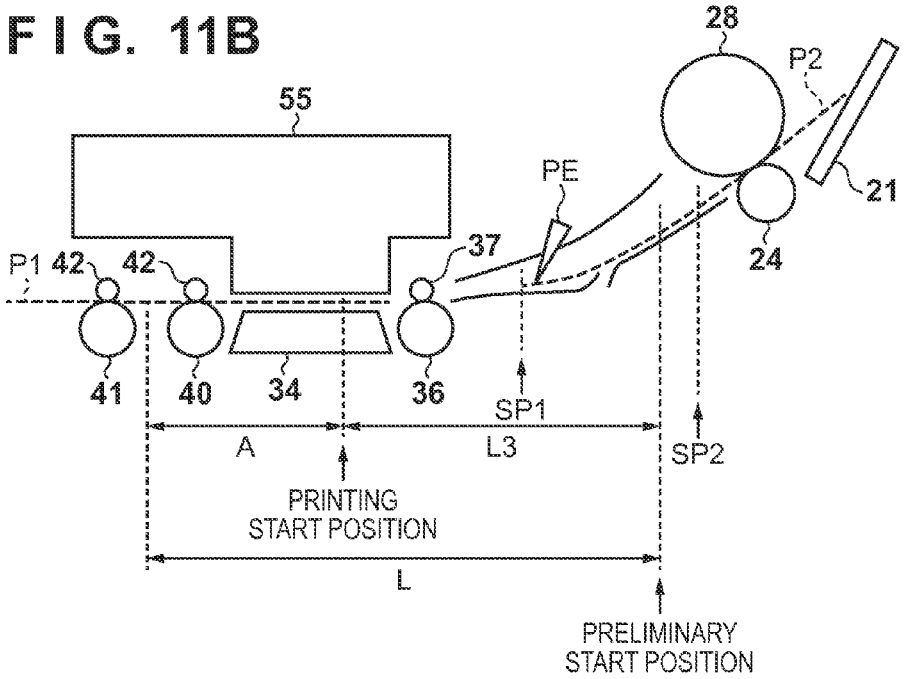

FIG. 10 shows an example of the processing executed by a CPU 71 of a control unit 7. FIGS. 11A and 11B are schematic views showing the operation of a printing apparatus 1. Referring to FIG. 11A, in this embodiment, the second stoppable position SP2 is set on the upstream side of the first stoppable position SP1. Furthermore, a preliminary start position is set in correspondence with the second stoppable position SP2.

"When the printing area S1 is long", the feeding of the subsequent printing medium P2 starts once the trailing end of the preceding printing medium has passed the successive feeding start position, and the feeding of the subsequent printing medium stops at a position where the leading end of the subsequent printing medium reaches the stoppable position SP1. "When the printing area S1 is short", the feeding of the subsequent printing medium P2 starts once the trailing end of the preceding printing medium has passed the preliminary start position, and the feeding of the subsequent printing medium stops at a position where the leading end of the subsequent printing medium reaches the stoppable position SP2. Which to choose can be determined in advance according to the length of the target image of printing.

FIG. 10 shows the example of the processing when images are printed successively on the plurality of printing media P, and illustrates a case in which the preliminary start position and the second stoppable position SP2 are used. A case in which the images are printed successively on two printing media is also assumed here. However, the same also applies to a case for three or more printing media.

First, the preceding printing medium P1 is fed by a feed roller 28, and stops at a position where the leading end thereof reaches the first stoppable position SP1. More specifically, a feeding operation starts upon receipt of a printing instruction from a host computer or the like (step S31). The feed roller 28 feeds the preceding printing medium P1. It is determined whether a sensor unit PE detects a leading end LE of the preceding printing medium P1 (step S32). If the detection is not made within a predetermined time, error processing is performed.

If the leading end LE of the preceding printing medium P1 is detected, the process advances to step S33. The preceding printing medium P1 stops at the position (first stoppable position SP1) where the printing medium is conveyed by a predetermined amount after the sensor unit PE detects the leading end of thereof.

Next, the process advances to a printing operation. In the printing operation, first, the preceding printing medium P1 whose leading end stops at the first stoppable position SP1 is conveyed to a printing start position by a printhead 50 (step S34). The feed roller 28 and a conveying roller 36 start rotating at the same time, thereby conveying the preceding printing medium P1 to the printing start position at a predetermined distance away from a nip portion between the conveying roller 36 and a pinch rollers 37.

After the preceding printing medium P1 is conveyed to the printing start position, a carriage 55 starts driving, and the printhead 50 discharges ink onto the preceding printing medium P1, thereby printing an image (step S35). Then, the conveying roller 36 is driven again to convey the printing medium P by a predetermined amount (step S36).

In step S37, it is determined whether the trailing end of the preceding printing medium P1 has passed the preliminary start position. If YES, the process advances to step S38; if NO, returns to step S39. Whether the trailing end of the preceding printing medium P1 has passed the preliminary start position is determined based on the driving amount of the conveying roller 36. As shown in FIGS. 11A and 11B, the driving amount is set with reference to a position where the leading end of the preceding printing medium P1 reaches the printing start position. When the conveying roller 36 conveys the preceding printing medium P1 by a conveyance amount A (A=L−L3), it is determined that the trailing end of the preceding printing medium P1 has passed the preliminary start position. A length L of the preceding printing medium P1 can be decided based on print setting information from the host computer. Alternatively, if a preceding printing medium P exists, the length L of the printing medium P can also be calculated based on information obtained by detecting the leading end and the trailing end of the printing medium P by the sensor unit PE.

In step S38, the feeding of the subsequent printing medium P2 starts. As shown in FIG. 11A, the subsequent printing medium P2 is fed to a position where the leading end thereof reaches the stoppable position SP2. Feeding the subsequent printing medium P2 to the stoppable position SP2 is also referred to as preliminary feeding. After that, the subsequent printing medium P2 stops at the stoppable position SP2 until the printing on the preceding printing medium P1 ends.

In step S39, it is determined whether the entire image has been printed on the preceding printing medium P1. If YES, the process advances to step S40; if NO, returns to step S35.

In step S40, the discharge of the preceding printing medium P1 starts. Concurrently with the discharging operation of the preceding printing medium P1, in step S41, the subsequent printing medium P2 is fed to a position where the leading end thereof reaches the stoppable position SP1, and then stopped. Subsequently, the process advances to step S42 in which the subsequent printing medium P2 is conveyed to the printing start position to perform the printing operation. After the subsequent printing medium P2 is conveyed to the printing start position, the carriage 55 starts driving, and the printhead 50 discharges ink onto the subsequent printing medium P2, thereby printing an image (step S43). Then, the conveying roller 36 is driven again to convey the subsequent printing medium P2 by a predetermined amount (step S44). The preceding printing medium P1 passes through a discharge roller 41 and is discharged onto the discharge tray while printing on the subsequent printing medium P2.

In step S45, it is determined whether the entire image has been printed on the subsequent printing medium P2. If YES, the process advances to step S46; if NO, returns to step S43. When the printing ends, the conveying roller 36 and the discharge roller 41 are driven at the same time to perform the discharging operation, thereby discharging the subsequent printing medium P2 onto the discharge tray.

As described above, even when the printing area S1 satisfies the relationship "S1<L−L2", and the trailing end of the preceding printing medium P1 never passes the successive feeding start position while printing on the preceding printing medium P1, it is possible to start feeding the subsequent printing medium P2 and thus shorten a total printing time. By positioning the second stoppable position SP2 immediately in front of a position where the driving stop state of the feeding unit 2 becomes unstable, it is possible to further shorten the total printing time. In this embodiment, a timing when a pressing plate 21 is separated from the feed roller 28 corresponds to a first unstable timing after the feeding unit 2 starts driving. For this reason, the second stoppable position SP2 may be set immediately in front of a position where the pressing plate 21 is separated from the feed roller 28.

Note that the following control is also possible as a modification. First, with the passage of the trailing end of the preceding printing medium P1 through the preliminary start position, the preliminary feeding of the subsequent printing medium P2 starts, and then stops at a position where the leading end thereof reaches the stoppable position SP2. Then, with the passage of the trailing end of the preceding printing medium P1 through the successive feeding start position, the feeding of the subsequent printing medium P2 starts again, and then stops again at a position where the leading end thereof reaches the first stoppable position SP1. This control also contributes to a shortened total printing time.

Third Embodiment

If the feeding of a subsequent printing medium P2 starts while an image is printed on a preceding printing medium P1, a feeding operation may cause the vibration of a printing apparatus 1. For example, when the feeding of the subsequent printing medium P2 starts, a pressing plate 21 contacts a feed roller 28. The pressing plate 21 contacts the feed roller 28 by the force of a pressing plate spring 212, and applies an impact load to the feed roller 28. A base 20 which holds the feed roller 28 and a chassis 11 which holds the base 20 generate a weak vibration by the load imposed on the feed roller 28. Because of the vibration transmitted to a carriage 55, the landing position of ink discharged from a printhead 50 onto the preceding printing medium P1 may deviate from an ideal position.

To prevent this, in a successive feeding operation, it is also possible to feed the board printing medium P2 while the preceding printing medium P1 is conveyed instead of feeding it while a printing unit 5 prints an image on the preceding printing medium P1.

By controlling, for example, preliminary feeding by a feeding unit 2, and the ink discharge timing by the carriage 55 and the printhead 50, it is possible to avoid the influence of the vibration generated by the pressing plate spring 212. The control will be described with reference to FIG. 12.

Figure 12:
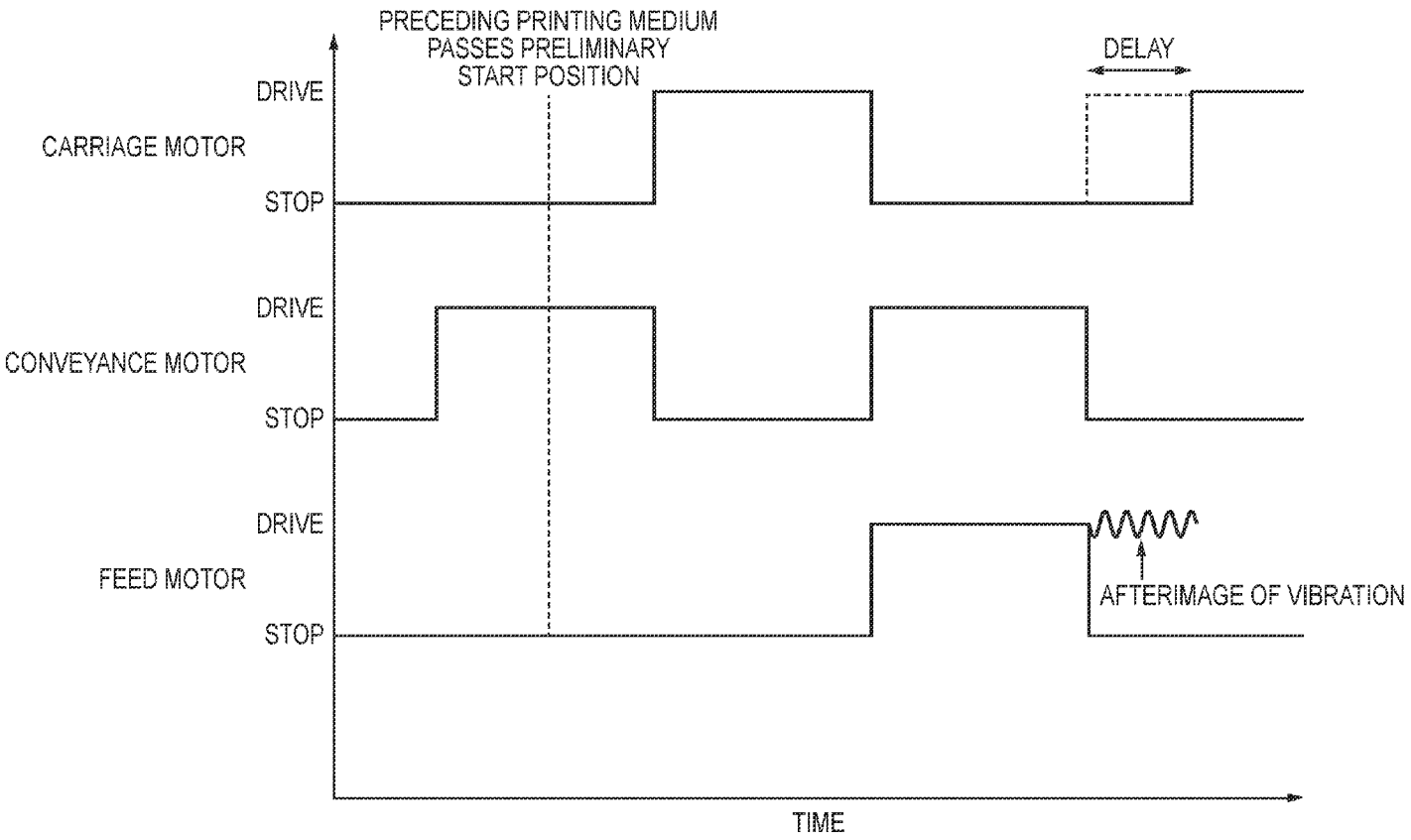
FIG. 12 is a timing chart showing the operation of each motor.

FIG. 12 is the timing chart of a carriage motor 54, a conveyance motor, and a feed motor during a printing operation on the preceding printing medium P1. As shown in FIG. 12, the feed motor starts driving not immediately after the trailing end of the preceding printing medium P1 passes a preliminary start position but at the next intermittent driving timing by the conveyance motor.

The conveyance motor and the carriage motor 54 operate almost alternately during printing. Therefore, by driving the feed motor and the conveyance motor at the same time, it is possible to operate the feed motor at a timing when the carriage motor 54 stops. That is, by driving the feed motor to perform preliminary feeding, the pressing plate 21 contacts the feed roller 28. It does not become a problem, however, because the timing can be placed while the carriage motor 54 stops and no ink is discharged.

The vibration generated when the pressing plate 21 contacts the feed roller 28 may remain afterward. In an example of FIG. 12, therefore, delay control which delays the driving start of the carriage motor 54 until no vibration remains is performed, thereby surely avoiding the influence of the vibration.

Fourth Embodiment

In FIG. 11A, when a printing area S2 satisfies "S2<(L−L3)" relative to a length L of a printing medium P (to be referred to as "when the printing area S2 is extremely short" hereinafter), a printing operation ends before the trailing end of a preceding printing medium P1 passes a preliminary start position. Hence, preliminary feeding cannot be performed. In this case, while discharging the preceding printing medium P1, the feeding of a subsequent printing medium P2 may be started once the trailing end of the preceding printing medium P1 passes the preliminary start position and continued until the leading end of the subsequent printing medium P2 reaches a first stoppable position SP1 (to be referred to as "feeding while discharging"). After that, the printing operation is performed as described above.

If a conveyance speed V1 (proportional to the driving speed of the feed motor) of the printing medium at the time of preliminary feeding is lower to some extent, the residual time of the vibration decreases, whereas a conveyance time increases. Accordingly, it is possible to further shorten a time taken to keep a carriage motor 54 wait and delay its driving start. This can achieve a shortened total printing time.

The higher a conveyance speed V2 (proportional to the driving speed of the feed motor) at which the printing medium is conveyed to the stoppable position SP1 after the preliminary feeding is, the shorter the total printing time can be. Therefore, by satisfying the conveyance speed V2>the conveyance speed V1, the total printing speed can be shortened while reducing the residual time of the vibration.

In the case of feeding while discharging, a timing at which a pressing plate 21 contacts a feed roller 28 is in the discharging operation of the preceding printing medium P1. So, the vibration does not influence the landing position accuracy of ink. Therefore, the higher a conveyance speed V3 (proportional to the driving speed of the feed motor) of the printing medium is, the shorter the total printing time can be. When the pressing plate 21 contacts the feed roller 28, however, noise is made to some extent. The conveyance speed at which the printing medium is conveyed to the stoppable position SP1 after feeding while discharging may be the conveyance speed V2 as in the case of preliminary feeding.

As described above, by satisfying the conveyance speed V2>the conveyance speed V3>the conveyance speed V1, it is possible to shorten the residual time of the vibration, reduce noise, and shorten the total printing time.

CONCLUSION

According to the printing apparatus of the above-described embodiments, it is possible to provide a printing apparatus which speeds up a feeding operation even in an arrangement in which a stop state is unstable when the arrangement of a feeding unit stops driving midway along feeding. Various methods other than described above can also be employed to determine that the leading end of a printing medium has reached a stoppable position and the trailing end has passed a successive feeding start position. The determination may be made, for example, using not a sensor unit PE but only the driving amount of a roller. On the contrary, the determination may be made, by arranging the sensor in each position, using not the driving amount of the roller but only the sensors. Note that as in these embodiments, the arrangement in which one sensor unit PE is provided in a feeding path can implement a simple arrangement and an accurate feeding operation.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2013-266134, filed Dec. 24, 2013, which is hereby incorporated by reference herein in its entirety.

What is claimed is:

1. A printing apparatus comprising:

a feeding unit configured to feed a printing medium;

a conveying unit configured to convey the printing medium fed from said feeding unit;

a printing unit configured to print an image on the printing medium conveyed by said conveying unit; and a control unit configured to perform a successive feeding operation of controlling said feeding unit to start feeding a subsequent printing medium before said printing unit finishes a printing operation of an image on a preceding printing medium, wherein an operating state of said feeding unit changes between a first operating state and a second operating state in which a feeding stop is more unstable than that in the first operating state, in a period from a start of feeding the printing medium until the printing medium reaching said conveying unit, in the successive feeding operation, said control unit controls said feeding unit to feed the subsequent printing medium without stopping until a leading end of the subsequent printing medium reaches a stoppable position which is arranged on an upstream side of said conveying unit and at which the subsequent printing medium can be stopped in the first operating state.

2. The apparatus according to claim 1, wherein said feeding unit includes:

a feed roller; and a movable portion which changes its position in the period from the start of feeding the printing medium until the printing medium reaches said conveying unit, and the second operating state corresponds to a state in which the movable portion is changing its position.

3. The apparatus according to claim 2, comprising a plurality of movable portions, wherein the second operating state corresponds to a state in which at least one said movable portion is changing its position, and the first operating state corresponds to a state in which all said movable portions do not change positions.

4. The apparatus according to claim 2, wherein the movable portion is:

a pressing plate, on which the printing medium is stacked, and which can move between a retreat position and a working position where the printing medium is ready to contact the feed roller;

a separation roller which can move between the retreat position and the working position where an erroneous conveyance of the multiple printing media is prevented by being pressed with pressure against the feed roller; or a return lever which can move to return the printing medium that has reached the feed roller to a side of the pressing plate.

5. The apparatus according to claim 2, wherein the stoppable position is set in accordance with a position of a printing area of the image on the preceding printing medium.

6. The apparatus according to claim 5, wherein candidate positions each of which can be set as the stoppable position include:

a first candidate position; and a second candidate position on an upstream side of the first candidate position in the conveying direction, when the second candidate position is set as the stoppable position, said control unit conveys the subsequent printing medium to the second candidate position at a first speed, and then to the first candidate position at a second speed, and the second speed is higher than the first speed.

7. The apparatus according to claim 6, wherein the first speed is higher in a case in which feeding of the subsequent printing medium starts after finishing the printing operation of the image on the preceding printing medium than that in a case in which the feeding of the subsequent printing medium starts before finishing the printing operation of the image on the preceding printing medium.

8. The apparatus according to claim 1, further comprising a sensor unit configured to detect a position of the printing medium, wherein a detection position by said sensor unit is set in a position on an upstream side of said conveying unit and a downstream side of said feeding unit in a conveying direction of the printing medium, and the stoppable position is positioned on the downstream side of the detection position in the conveying direction.

9. The apparatus according to claim 1, wherein when the image is printed on the printing medium, said conveying unit intermittently conveys the printing medium, and said printing unit prints the image while said conveying unit stops conveying the printing medium, and in the successive feeding operation, the subsequent printing medium is not fed while said printing unit prints the image on the printing medium.

10. A printing apparatus comprising:

a feeding unit configured to feed a printing medium;

a conveying unit configured to convey the printing medium fed from said feeding unit;

a printing unit configured to print an image on the printing medium conveyed by said conveying unit; and a control unit configured to perform a successive feeding operation of controlling said feeding unit to start feeding a subsequent printing medium before said printing unit finishes a printing operation of an image on a preceding printing medium, wherein an operating state of said feeding unit changes, between a first operating state and a second operating state in which a feeding stop is more unstable than that in the first operating state, in a period from a start of feeding the printing medium until the printing medium reaching said conveying unit, and said control unit does not stop feeding the subsequent printing medium in the second operating state and stops feeding the subsequent printing medium after a change from the second operating state to the first operating state is made.

* * * * *